US006037876A

United States Patent [19]

Crouch

[11] Patent Number: 6,037,876

[45] Date of Patent: Mar. 14, 2000

[54] LIGHTED MESSAGE FAN

[75] Inventor: James C. Crouch, Huntertown, Ind.

[73] Assignee: Limelite Industries, Inc., Huntertown, Ind.

[21] Appl. No.: 09/065,351

[22] Filed: Apr. 23, 1998

[51] Int. Cl.[7] ..... G08B 5/36; G09G 3/00

[52] U.S. Cl. ..... 340/815.53; 340/815.54; 340/815.86; 345/31; 345/126

[58] Field of Search ..... 340/815.53, 815.54, 340/815.64, 815.86, 815.87, 815.88; 345/31, 126; 362/147, 360, 294

[56] References Cited

U.S. PATENT DOCUMENTS

| | | | |
|---|---|---|---|
| 4,099,172 | 7/1978 | Montanari et al. | 345/31 |
| 4,470,044 | 9/1984 | Bell | 345/31 |
| 4,689,604 | 8/1987 | Sokol | 345/31 |
| 5,028,206 | 7/1991 | Kendregan et al. | 416/5 |
| 5,057,827 | 10/1991 | Nobile et al. | 345/31 |
| 5,302,965 | 4/1994 | Belcher et al. | 345/31 |
| 5,748,157 | 5/1998 | Eason | 345/31 |

*Primary Examiner*—Donnie L. Crosland
*Attorney, Agent, or Firm*—Taylor & Associates, P.C.

[57] ABSTRACT

A method of emitting a visual image from a lighted display includes the step of providing at least one body which is rotatable in at least one rotation direction about an axis of rotation. A plurality of substantially circular image lines are defined, with each image line overlying a respective body. Each image line is concentrically disposed around a respective axis of rotation at a respective radial distance from the axis of rotation. A plurality of light sources are provided and are carried by the at least one body. Each light source is associated with and overlies a respective image line. The at least one body is rotated about the axis of rotation in a plurality of rotations. A rotational speed of the at least one body is determined. A plurality of positions are calculated for at least one of the light sources along the image line dependent upon the rotational speed. The at least one light source is individually switched between an energized state and a deenergized state dependent upon the calculated plurality of positions.

19 Claims, 2 Drawing Sheets

LIGHTED MESSAGE FAN

BACKGROUND OF THE INVENTION

1. Field of the Invention

The present invention relates to rotating bodies, and, more particularly, illuminated rotating bodies.

2. Description of the Related Art

A rotating body in the form of a ceiling fan is well known in the prior art for circulating air in rooms of buildings. These fans are generally equipped with a motor having a rotor to which are connected radially extending blades. It is further known in the art to combine a ceiling fan with a light source so that the combined unit serves as both a fan and light fixture for illuminating the room. A typical combined ceiling fan and lighting fixture includes a central light source located beneath the motor. U.S. Pat. No. 5,028,206 (Kendregan, et al.) discloses an illuminated ceiling fan in which a source of illumination is secured to the outer periphery of rotating blades for rotation therewith. Although the illuminated periphery of the moving blades is aesthetically pleasing, the variety of images which can be produced by such illuminated blades is limited. For instance, the illuminated blades are not capable of producing a lighted image in the form of letters, words or graphic images.

What is needed in the art is a method of emitting a visual image in the form of alphanumeric characters from a rotating body.

SUMMARY OF THE INVENTION

The present invention provides a method of emitting a lighted visual image in the form of letters, words or detailed graphic logos from a rotating body, such as a ceiling fan.

The invention comprises, in one form thereof, a method of emitting a visual image from a lighted display. The method includes the step of providing at least one body which is rotatable in at least one rotation direction about an axis of rotation. A plurality of substantially circular image lines are defined, with each image line overlying a respective body. Each image line is concentrically disposed around a respective axis of rotation at a respective radial distance from the axis of rotation. A plurality of light sources are provided and are carried by the at least one body. Each light source is associated with and overlies a respective image line. The at least one body is rotated about the axis of rotation in a plurality of rotations. A rotational speed of the at least one body is determined. A plurality of positions are calculated for at least one of the light sources along the image line dependent upon the rotational speed. The at least one light source is individually switched between an energized state and a deenergized state dependent upon the calculated plurality of positions.

An advantage of the present invention is that a detailed visual image, such as letters or a logo, can be emitted from a lighted display on a rotating body.

Another advantage is that the novelty of the present invention is likely to attract attention, in that a seemingly stationary lighted visual image is emitted from a rotating body.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
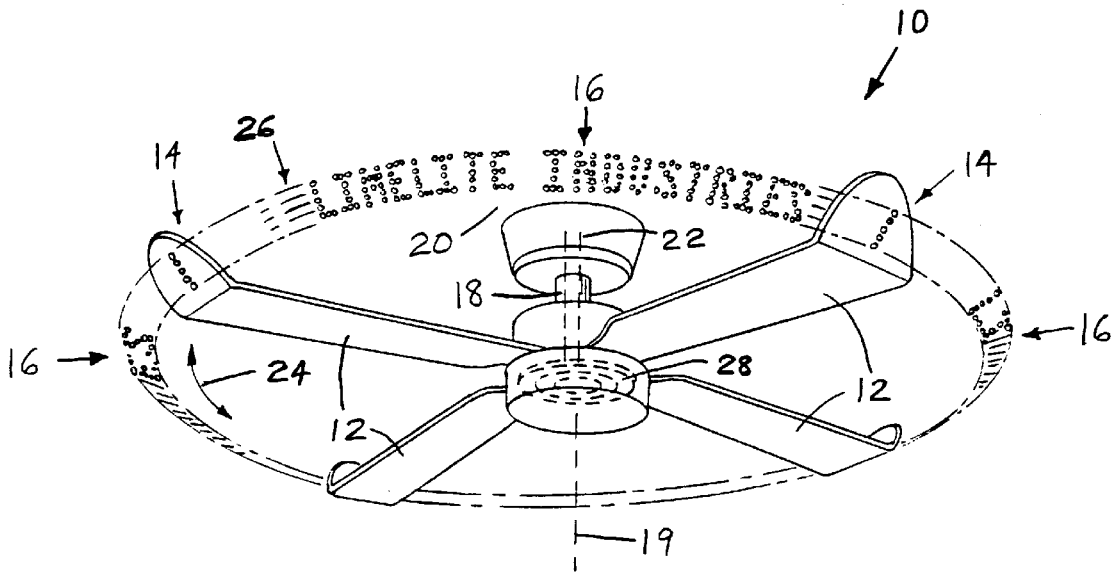
FIG. 1 is a perspective view of one embodiment of the method of the present invention in which a visual image is emitting from a ceiling fan.

Referring now to the drawings, and more particularly to FIG. 1, there is shown a ceiling fan 10 including blades 12, with each blade 12 having a series of lights 14 emitting a visual image 16.

Ceiling fan 10 includes a tubular support conduit 18 which defines an axis of rotation 19 and extends from a ceiling 20. Conduit 18 contains electrical wiring 22 which carries electrical power to a drive mechanism (not shown) including a motor which drives ceiling fan 10. Such a drive mechanism is well known in the art, and thus, a detailed description of the drive mechanism is not included herein as it is not necessary for an understanding of the present invention.

A row of lights 14 is included on a distal end of each of blades 12. Each row of lights 14 is oriented substantially perpendicular to the directions of rotation indicated by double arrows 24. As blades 12 rotate about axis of rotation 19, each of lights 14 follows a respective substantially circular image line 26. Each of lights 14 may be powered through a slip ring 28, or lights 14 may be powered by one or more batteries (not shown) which may be carried by and rotate along with blades 12.

Figure 3:
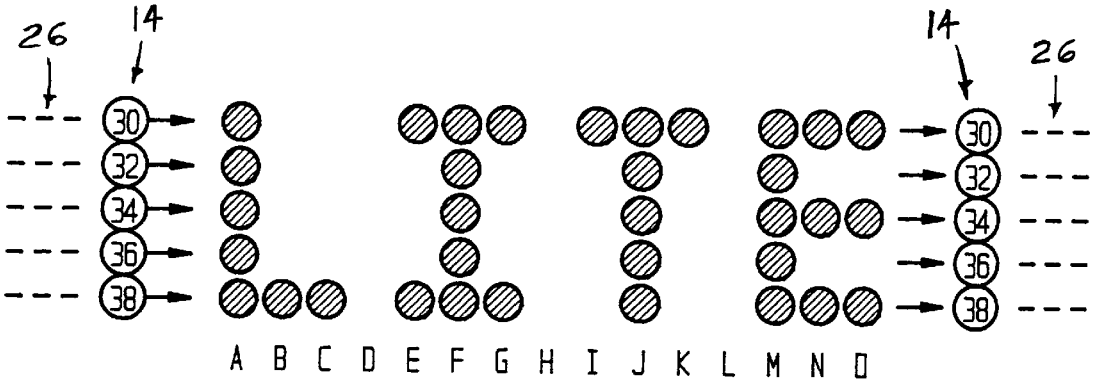
FIG. 3 is a representation of a visual image emitted by the method of the present invention.
Figure 5:
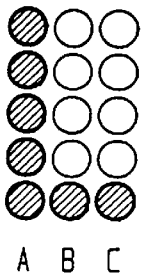
FIG. 5 is a schematic view of light sources of the method of the present invention disposed in positions A–C of FIG. 3.

FIG. 3 is an enlarged, fragmentary view of the visual image of FIG. 1. The visual image may be continuous or may be interrupted, i.e., may flash ON and OFF. Individual lights 30, 32, 34, 36 and 38 of each set of lights 14 are energized or deenergized in each of positions A–O according to the sequence shown in FIG. 3. The sequence of light energization shown in FIG. 3 is an example for illustrative purposes only, and it is to be understood that lights 14 can be energized and deenergized in any desired sequence to emit any particular image. Each circular image line 26 is divided into a plurality of positions, a subset of which is labeled by the letters A–O in FIG. 3. In position A, each of lights 30, 32, 34, 36 and 38 are energized. In each of positions B and C, only light 38 is energized. The locations of each of deenergized lights 30, 32, 34 and 36 in positions B and C are as shown in FIG. 5. In position D, which is used as a space between letters in producing the visual image of FIG. 3, none of lights 14 are energized. Each light is associated with a same image line 26 as a corresponding light on the adjacent blade 12 shown in FIG. 1. The two rear fan blades 12 of FIG. 1 may also have rows of lights substantially identical to the rows of lights 14 shown on the front fan blades. Such rows of lights on the two rear fan blades may be associated with the same image lines 26.

Lights 14 associated with a same image line 26 energize and deenergize in the same sequence at the same positions. For instance, each light 30 is energized at position A and is deenergized at positions B–D. All positions are fixed in space and do not rotate along with blades 12. If the rotational speed of blades 12 is sufficiently high, and the travel time of lights 14 between two adjacent positions, such as positions A and B, is sufficiently short, then the sequence of energizations in positions A through C will appear to form the capital letter L. Thus, the letter L will appear to flash ON and OFF upon each passing of a set of lights 14. At a yet higher rotational speed of blades 12, with a correspondingly shorter travel time between adjacent positions, each letter will appear to remain constantly lit instead of flashing on and off with each energization and deenergization. If a set of lights 14 energizes and deenergizes at a given position twenty or more times per second, the human eye is incapable of perceiving the energizations and deenergizations and perceives the lights to be continuously lit. With four sets of lights 14, this threshold rotational speed is approximately 5 rotations per second, corresponding to an energizing frequency of approximately 20 Hz.

Lights 14 are shown as being momentarily energized in discrete positions while being deenergized in the spaces between adjacent positions. For example, light 38 is shown in FIG. 3 as being energized in each of positions A, B and C while being deenergized in the space between positions A and B and in the space between positions B and C. This deenergizing of lights 14 in the gaps between adjacent positions results in the visual image being divided into discrete pixels along a particular image line. However, it is to be understood that it is also possible for an individual one of lights 14 to remain energized between two adjacent positions in which the light is energized. For example, in creating the visual image of FIG. 3, light 38 can remain energized between positions A and B and between positions B and C. This energizing of lights 14 in the gaps between adjacent positions enables the visual image to include a continuous line or line segments along a particular image line.

Figure 4:
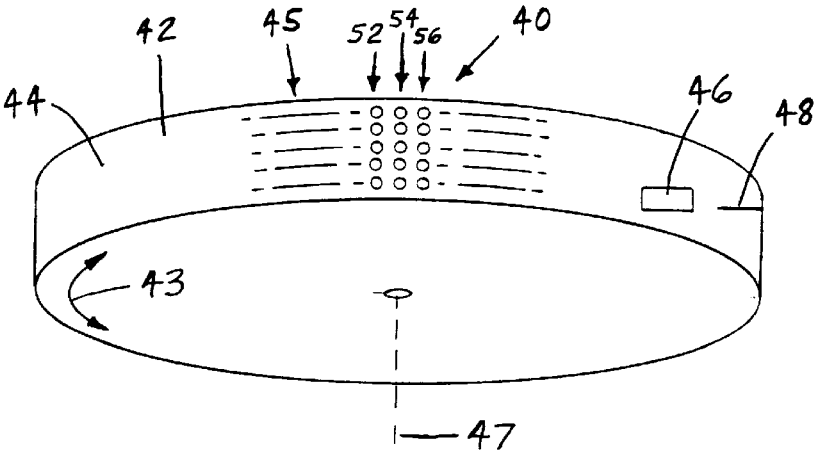
FIG. 4 is a perspective view of a rotating body incorporated in another embodiment of the method of the present invention.

Lights 14 may be disposed on a rotating body other than a ceiling fan. An array of lights 40 is shown in FIG. 4 as being disposed on a disc-like rotating body 42. Array of lights 40 is arranged in five rows and three columns 52, 54 and 56 on a circumference 44 of rotating body 42. Each row of array 40 is oriented substantially parallel to the directions of rotation, as indicated by double arrows 43. Each of the five rows of array of lights 40 is associated with one of image lines 45. Image lines 26 of ceiling fan 10 are concentric, but have different radial distances from axis of rotation 19. In the rotating body 42 of FIG. 4, however, image lines 45 are concentric and also have substantially equal radial distances from an axis of rotation 47.

Figure 2:
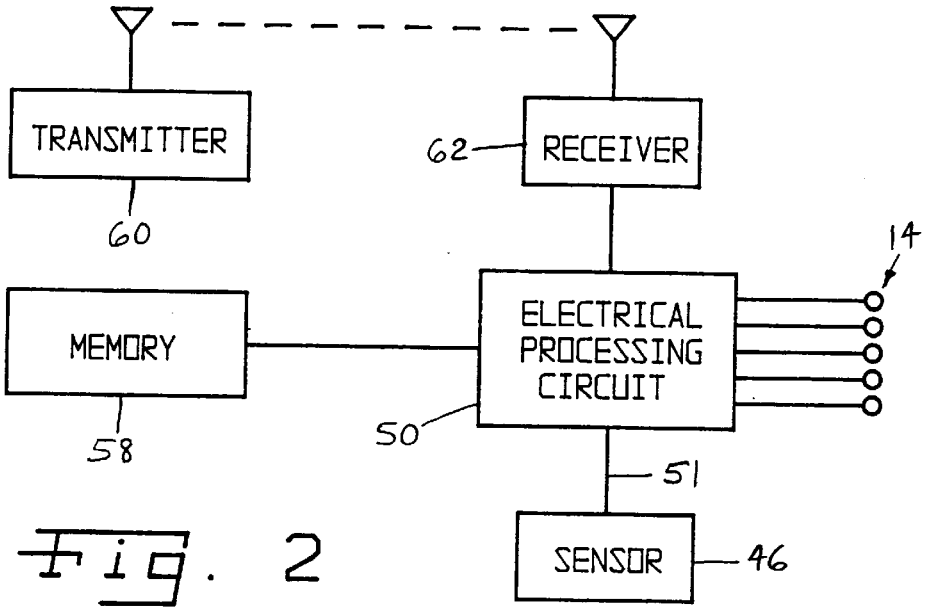
FIG. 2 is a block diagram of a controlling circuit used in the method of FIG. 1.

A stationary sensor 46 is used to sense the passing of one or more markers 48, which are disposed on some rotating part of body 42. Sensor 46 transmits a signal to an electrical processing circuit (EPC) 50 (FIG. 2) over conductor 51 each time sensor 46 senses the passing of a marker 48, which may be in the form of a slot in an encoder disc. Sensor 46 may optically sense the slot and send associated signals in the form of electrical feedback pulses, also known as "encoder pulses". EPC 50 measures a time period between receptions of signals from sensor 46, and calculates the rotational speed of body 42 based upon the time period between signals. It is also possible for sensor 46 to rotate along with blades 12. Sensor 46 would then sense its own passing of one or more markers attached to some stationary framework associated with the rotating body. Sensor 46 is not shown on ceiling fan 10 in FIG. 1 in order to simplify the illustration; however, sensor 46 can also be included in ceiling fan 10.

Based upon the determined rotational speed of body 42, EPC 50 calculates a position along an image line 45 for each of lights 40. EPC 50 is electrically connected to each of lights 40 and individually switches each of lights 40 between an energized state and a deenergized state dependent upon the calculated positions of lights 40. For instance, when EPC 50 calculates that columns 52, 54 and 56 are in positions A–C, respectively, EPC 50 will energize each of the five lights in column 52 and the bottom light of each of columns 54 and 56, as shown in FIG. 5.

It is possible, in a first energization algorithm, to divide the positions along image lines 45 into groups and to energize array of lights 40 only when array 40 is completely within that group of positions. For instance, selected lights of array of lights 40 can be energized when columns 52, 54 and 56 are in positions A–C respectively, E–G respectively, I–K respectively, and M–O respectively, to form the image of FIG. 3.

In a second energization algorithm, alternatively, each of columns 52, 54 and 56 can be energized based solely upon each particular column's individual position along image lines 45. In this second algorithm, as in the first algorithm, array 40 is energized to form the letter L when columns 52, 54 and 56 are in respective positions A–C, as described above. However, in contrast to the first algorithm, when column 56 advances to position D, assuming a clockwise rotation as viewed from the bottom of FIG. 4, the bottom light of each of columns 52 and 54, now in positions B and C, remains energized. As column 56 advances to position E, its lights in the top row and the bottom row become energized to form the left end of the letter I; in position D, column of lights 54 are all deenergized between letters; and in position C, only the bottom row light of column 52 is energized to form the right hand end of letter L. This second energizing algorithm results in each one of the columns of array of lights 40 possibly being energized in each of the positions, rather than each column being possibly energized in only one position within each group of positions, as in the second algorithm. Hence, assuming each of the groups of positions includes three positions, each column of lights is energized for three times as long, providing a brighter visual image.

A desired sequence of energizations to form particular letters or logos may be preprogrammed into a memory device 58, which may be, for example, an EEPROM. It is possible for memory device 58 to contain only the energization sequence for each position of one full rotation. Alternatively, memory device 58 may contain several different energization sequences, one or more of which may be selected by the user. The energization sequences may also be switched every few seconds in order to provide a series of visual images including different words or logos.

Instead of preprogramming memory 58 with a desired energization sequence, it is also possible to remotely transmit a digitally encoded version of the visual image to EPC 50. Well known transmitters and receivers using, for example, radio frequency or infrared technology can be used. A transmitter 60 transmits to EPC 50 via a receiver 62 a digitally encoded representation of the visual image to be emitted. It is also possible to use remote transmitter 60 to only select one or several of a large number of preprogrammed energization sequences stored in memory 58.

It is possible for array of lights 40 to include two separate light sources which emit different colors of light. If two separate differently colored light sources are in a same row of array 40 and are associated with a same image line 45, the differently colored lights can have different energization states within at least one position along their common image line 45. That is, a light of one color may be energized in one position, while a light of another color is energized in another position. Thus, differently colored lights may be used not only to emit a multi-colored lighted visual image, but even a lighted visual image having different colors along the same image line. The same effect can be achieved with a two-color light emitting diode, i.e., a diode capable of emitting light in two different colors. It is also possible for differently colored light sources in a same row of array 40 to both be energized within a same position in order to create the perception of a third color. For example, a blue light source and a yellow light source within a same row and associated with a same image line can both be energized within a position X in order to create the perception of a green light source within position X.

The energization sequence controlled by EPC 50 can be reversed if the direction of rotation of either ceiling fan 10 or rotating body 42 is reversed. It is common for ceiling fans to have a switch (not shown) which selects one of two possible directions of rotation in order to blow air away from or toward the ceiling. EPC 50 can sense the position of such a switch and control the energization sequence accordingly. For example, if rotating body 42 were to be rotated counterclockwise as viewed from the bottom of FIG. 4, columns 52, 54 and 56 would proceed from position O of FIG. 3 in a right to left direction toward position A.

In the above embodiments, EPC 50 senses the speed of the rotating body and energizes and deenergizes the lights at appropriate points in time. However, in another embodiment (not shown), EPC 50 not only controls the energizations of light sources based upon measured rotational speeds of the rotating body, but also controls or regulates the rotational speed of the rotating body in order to emit the visual image. EPC 50 can control or regulate the power supplied to the motor which drives the rotating body, thereby controlling or regulating the rotational speed of the rotating body as needed to achieve some desired rotational speed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of emitting a visual image from a lighted display, said method comprising the steps of:

providing at least one body which is rotatable in at least one rotation direction about an axis of rotation;

defining a plurality of substantially circular image lines, each said image line overlying a respective said body, each said image line being concentrically disposed around a respective said axis of rotation at a respective radial distance from said axis of rotation;

providing a plurality of light sources carried by said at least one body, each said light source being associated with and overlying a respective said image line;

rotating said at least one body about said axis of rotation in a plurality of rotations;

determining a rotational speed of said at least one body;

calculating a plurality of positions for at least one of said light sources along said image line dependent upon said rotational speed;

individually switching said at least one light source between an energized state and a deenergized state dependent upon said calculated plurality of positions; and remotely transmitting a digitally encoded version of the visual image to said electrical controller.

2. The method of claim 1, wherein said determining step includes the substeps of:

providing at least one marker on a circumference of said at least one body;

sensing each said rotation of said at least one marker by using a sensor associated with said circumference;

transmitting a plurality of signals from said sensor to an electrical controller, each said signal being dependent upon said sensed rotation of said at least one marker;

measuring a time period between receptions of said plurality of signals using said electrical controller; and computing said rotational speed of said at least one body dependent upon said measured time period using said electrical controller.

3. The method of claim 2, wherein said calculating step is performed by said electrical controller.

4. The method of claim 1, wherein said at least one rotation direction comprises two opposite rotation directions, further comprising the step of selecting one of said two opposite rotation directions, said switching step being dependent upon said selected rotation direction.

5. The method of claim 1, comprising the further step of storing said digitally encoded version of the visual image in a memory device.

6. The method of claim 1, wherein each said light source has a selected said state corresponding to each said position along said image line.

7. The method of claim 6, wherein at least two of said plurality of light sources are associated with a same said image line, said at least two light sources having same said states corresponding to each said position along said same image line.

8. The method of claim 6, wherein at least two said light sources are associated with a same said image line and emit different colors of light, said at least two light sources having different said states corresponding to at least one said position along said same image line.

9. The method of claim 1, wherein the lighted display includes alphanumeric characters.

10. The method of claim 1, comprising the further step of supplying electrical power to said plurality of light sources via a slip ring.

11. The method of claim 1, wherein said rotational speed of said at least one body is such that the visual image appears to be constant with time.

12. The method of claim 1, wherein said plurality of light sources are arranged in at least one row of light sources.

13. The method of claim 12, wherein at least one said row of light sources is oriented substantially parallel to at least one said rotation direction.

14. The method of claim 12, wherein at least one said row of light sources is oriented substantially perpendicular to at least one said rotation direction.

15. The method of claim 1, wherein said plurality of light sources are arranged in a rectangular array having a plurality of rows and a plurality of columns.

16. The method of claim 1, wherein each said circular image line has a substantially equal said radial distance from said axis of rotation.

17. The method of claim 1, wherein each said circular image line has a different said radial distance from said axis of rotation.

18. A method of emitting a visual image from a lighted display, said method comprising the steps of:

providing a fan having a plurality of blades and being rotatable in two opposite rotation directions about an axis of rotation;

defining a plurality of substantially circular image lines, each said image line overlying said fan, each said image line being concentrically disposed around said axis of rotation at a respective radial distance from said axis of rotation;

providing a plurality of light sources carried by said plurality of blades of said fan, each said light source beings associated with and overlying a respective said image line;

selecting one of said two opposite rotation directions;

rotating said fan in said selected rotation direction about said axis of rotation in a plurality of rotations;

determining a rotational speed of said fan;

calculating a plurality of positions for at least one of said light sources along said image line dependent upon said rotational speed and said selected rotation direction; and individually switching said at least one light source between an energized state and a deenergized state dependent upon said calculated plurality of positions.

19. A method of emitting a visual image from a lighted display, said method comprising the steps of:

providing at least one fan having a plurality of blades and being rotatable in at least one rotation direction about an axis of rotation;

defining a plurality of substantially circular image lines, each said image line overlying a respective said fan, each said image line being concentrically disposed around a respective said axis of rotation at a respective radial distance from said axis of rotation, each said respective radial distance being different from other said respective radial distances providing a plurality of light sources carried by said plurality of blades of said at least one fan, each said light source being associated with and overlying a respective said image line;

rotating said at least one fan about said axis of rotation in a plurality of rotations;

determining a rotational speed of said at least one fan;

calculating a plurality of positions for at least one of said light sources along said image line dependent upon said rotational speed; and individually switching said at least one light source between an energized state and a deenergized state dependent upon said calculated plurality of positions.

* * * * *